US007368871B2

(12) United States Patent
Kim

(10) Patent No.: US 7,368,871 B2
(45) Date of Patent: May 6, 2008

(54) PLASMA DISPLAY APPARATUS WITH IMPROVED SUBSTRATES

(75) Inventor: Jin-Sub Kim, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 89 days.

(21) Appl. No.: 11/000,400

(22) Filed: Nov. 29, 2004

(65) Prior Publication Data

US 2005/0116647 A1 Jun. 2, 2005

(30) Foreign Application Priority Data

Nov. 29, 2003 (KR) ..... 10-2003-0086128

(51) Int. Cl.
*H01J 17/49* (2006.01)
*H01J 17/00* (2006.01)
*H01J 61/00* (2006.01)

(52) U.S. Cl. ..... 313/582; 313/586; 313/581; 445/24

(58) Field of Classification Search ..... 313/582
See application file for complete search history.

(56) References Cited

U.S. PATENT DOCUMENTS 3,778,127 A * 12/1973 Langston et al. ..... 313/582
5,422,747 A * 6/1995 Wakita ..... 349/143
6,361,867 B2 * 3/2002 Kishida et al. ..... 428/428
6,572,236 B2 * 6/2003 Suzuki et al. ..... 349/65
7,059,473 B2 6/2006 Watanabe et al.
7,091,665 B2 * 8/2006 Nomoto et al. ..... 313/583

FOREIGN PATENT DOCUMENTS

| | | |
|---|---|---|
| CN | 1378968 A | 11/2002 |
| JP | 61-206562 | 9/1986 |
| JP | 7-186022 | 7/1995 |
| JP | 8-62612 | 3/1996 |
| JP | 8-197402 | 8/1996 |
| JP | 11-92170 | 4/1999 |
| JP | 2000-89692 | 3/2000 |

(Continued)

OTHER PUBLICATIONS

Patent Abstracts of Japan, Publication No. 07-186022; Date of Publication: Jul. 25, 1995; in the name of Kazumi Kagami et al.

(Continued)

*Primary Examiner*—Sikha Roy
*Assistant Examiner*—Natalie K. Walford
(74) *Attorney, Agent, or Firm*—Christie, Parker & Hale, LLP

(57) ABSTRACT

A plasma display apparatus includes a plasma display panel having a first substrate, a second substrate facing the first substrate and sealed thereto, and a plasma discharge structure disposed between the first and second substrates. A chassis base is positioned close to the plasma display panel at one surface side and in parallel with the panel. A driving circuit is mounted on the opposite surface side of the chassis base and electrically connected to the plasma display panel to drive the panel. The first and second substrates of the plasma display panel have chamfered portions formed along the edges of the first and second substrate surfaces that face away from each other.

14 Claims, 4 Drawing Sheets

FOREIGN PATENT DOCUMENTS

| | | |
|---|---|---|
| JP | 2000-268737 | 9/2000 |
| JP | 2003-16926 | 1/2003 |
| JP | 2003-308792 | 10/2003 |
| KR | 10-2005-0044146 | 5/2005 |

OTHER PUBLICATIONS

Patent Abstracts of Japan, Publication No. 11-092170; Date of Publication: Apr. 6, 1999; in the name of Hideki Yamaoka et al.

Korean Patent Abstracts, Publication No. 1020050044146 A; Date of Publication: May 12, 2005; in the name of Cheol Hee Moon.

Patent Abstracts of Japan, Publication No. 2003-308792, dated Oct. 31, 2003, in the name of Chiyomaro Hirata et al.

Patent Abstracts of Japan, Publication No. 61-206562; Date of Publication: Sep. 12, 1986; in the name of Shiro Komata, et al.

Patent Abstracts of Japan, Publication No. 08-062612; Date of Publication: Mar. 8, 1996; in the name of Soyama.

Patent Abstracts of Japan, Publication No. 08-197402; Date of Publication: Aug. 6, 1996; in the name of Hiroshi Soyama, et al.

Patent Abstracts of Japan, Publication No. 2000-089692; Date of Publication: Mar. 31, 2000; in the name of Harada, et al.

Patent Abstracts of Japan, Publication No. 2003-016926; Date of Publication: Jan. 17, 2003; in the name of Sakamoto.

* cited by examiner

PLASMA DISPLAY APPARATUS WITH IMPROVED SUBSTRATES

CROSS-REFERENCE TO RELATED APPLICATIONS

This application claims priority of Korean Patent Application number 10-2003-0086128, filed Nov. 29, 2003, the entire disclosure of which is incorporated herein by reference.

BACKGROUND OF THE INVENTION

1. Field of the Invention

The present invention relates to a plasma display apparatus, and in particular, to a plasma display apparatus which is manufactured through simultaneously making a plurality of panels at a large-sized glass disk, and cutting them to the respective panel sizes thereof.

2. Description of Related Art

Generally, a plasma display panel (simply referred to hereinafter as a "PDP") is a display device which excites phosphors with ultraviolet rays generated through gas discharge, and displays desired images. As the PDP makes it possible to construct a high-resolution wide-screened display device, it has been spotlighted as a future generation flat panel display.

With the common PDP, a glass substrate is used to form a front substrate, and another glass substrate is used to form a rear substrate. This involves poor productivity and high production cost. Accordingly, a multi-panel technology has been recently developed and made ready to be applied to manufacturing process. According to the multi-panel technology, a plurality of panels are simultaneously made in a large-sized mother glass, and then cut to form the respective panel sizes therefrom.

However, during the process of cutting the respective PDPs, the panel edges are inevitably somewhat flawed. The small flaws are liable to grow into critical panel cracks with the subsequent processing and under physical impacts due to transportation or the like, thereby causing failure of the panel as well as of the glass substrate.

SUMMARY OF THE INVENTION

It is an aspect of the present invention to provide a plasma display apparatus which prevents substrates from suffering cracks, and which provides enhanced panel definition, through making a plurality of panels of a glass substrate, cutting the panels to respective desired panel sizes, and chamfering the edges thereof.

In one embodiment of the present invention a plasma display apparatus includes a PDP having a first substrate, a second substrate facing the first substrate at one surface side and sealed thereto, and a plasma discharge structure disposed between the first and second substrates. A chassis base is positioned in close proximity to the plasma display panel at one surface side thereof and in parallel with the plasma display panel. A driving circuit is mounted at the opposite side surface of the chassis base and electrically connected to the PDP to drive it. The first and second substrates of the plasma display panel have chamfered portions formed along the edges of the first and second substrate surfaces that face away from each other.

The first and second substrates are shaped as rectangular parallelepipeds each having long and short sides. The long side of the first substrate is larger than the long side of the second substrate, and the short side of the first substrate is smaller than the short side of the second substrate. The surface of the first substrate facing the second substrate has a chamfered portion processed along the edge of the short side thereof, and the surface of the second substrate facing the first substrate has a chamfered portion processed along the edge of the long side thereof.

The chamfered portions formed at the edges of the first and second substrates are angled by 30-45° against the substrate surface adjacent thereto.

The chamfered portions formed at the edges of the first and second substrates may be rounded with a curvature radius R of 0.9-1.5 mm.

The chamfered portion is formed by grinding the respective edge with a grinder, or firing it with a torch lamp.

According to another aspect of the present invention, the longitudinal edges of the long side of the first substrate have different edge angles, and the longitudinal edges of the short side of the second substrate have different edge angles.

With respect to the longitudinal edges of the long side of the first substrate with the different edge angles, the edge angle of the edge adjacent to the second substrate is smaller than the edge angle of the opposite side edge. For instance, it may be established that the edge angle of the edge adjacent to the second substrate is 90°, and the edge angle of the opposite side edge is an obtuse angle.

With respect to the longitudinal edges of the short side of the second substrate with the different edge angles, the edge angle of the edge adjacent to the first substrate is smaller than the edge angle of the opposite side edge. For instance, it may be established that the edge angle of the edge adjacent to the first substrate is 90°, and the edge angle of the opposite side edge is an obtuse angle.

In one embodiment, the plasma display panel includes cutting edges along edges intersecting each other at a corner of the plasma display panel and the edges provided for the respective surfaces of the first substrate and the second substrate that face each other.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENTS

The present invention will be described more fully hereinafter with reference to the accompanying drawings, in which embodiments of the invention are shown.

Figure 1:
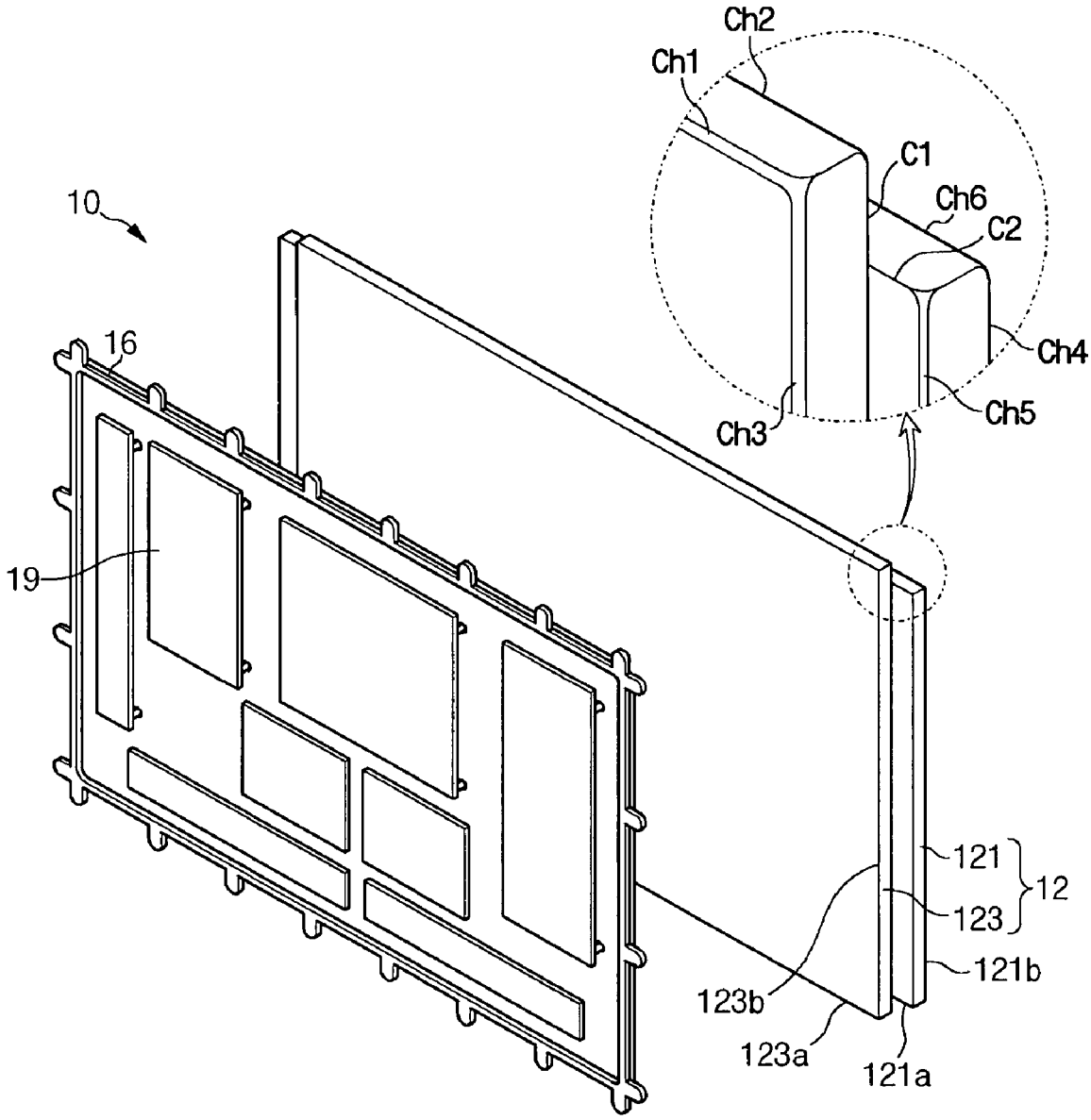
FIG. 1 is an exploded perspective view of a plasma display apparatus with a PDP according to an embodiment of the present invention.
Figure 2:
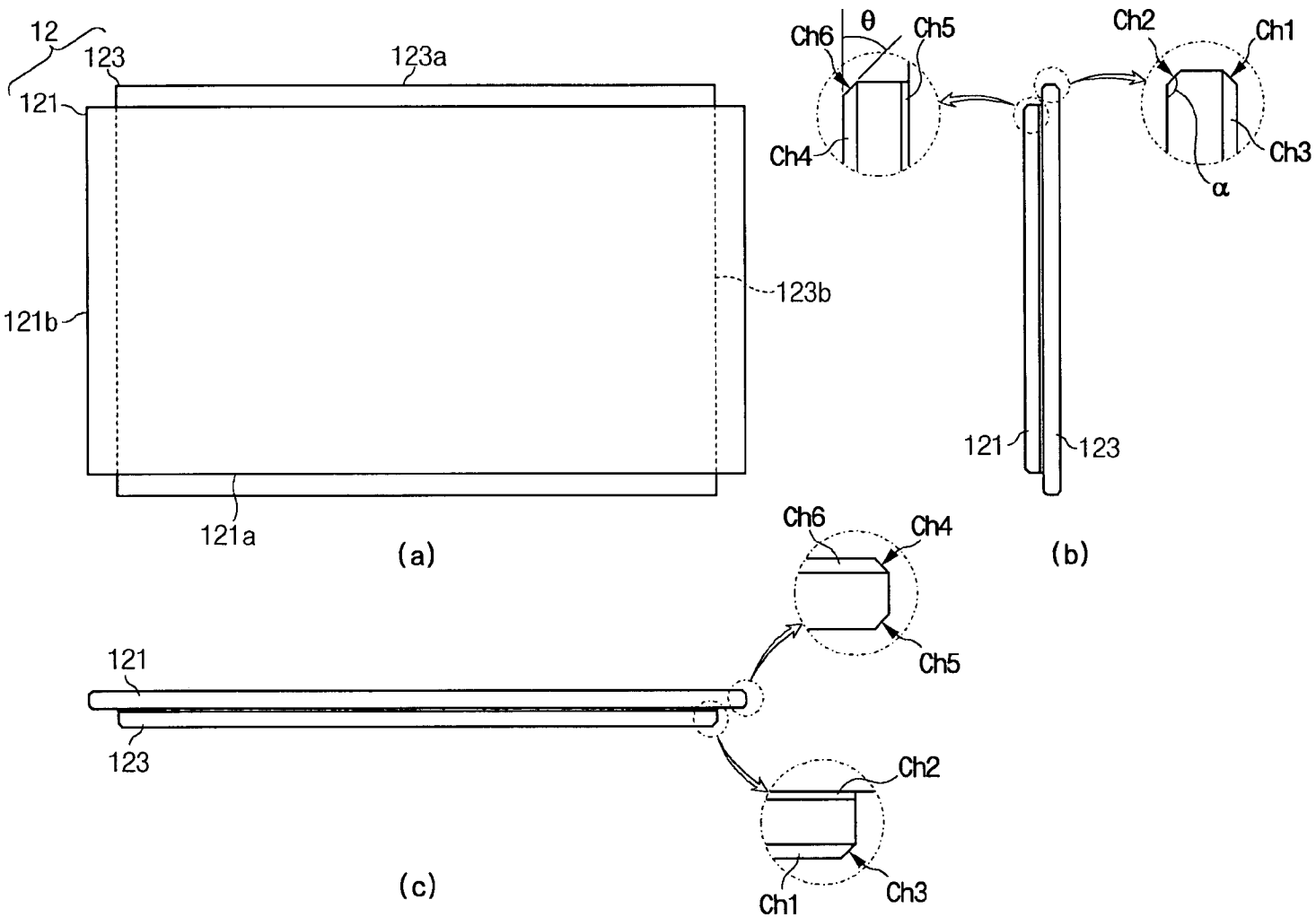
FIGS. 2(*a*) to (*c*) are front, side, and bottom views of the PDP shown in FIG. 1, respectively.

FIG. 1 is a partial exploded perspective view of a plasma display apparatus with a PDP according to an embodiment of the present invention, and FIGS. 2(*a*) to 2(*c*) are front, side, and bottom views of the PDP, respectively.

As shown in the drawings, the plasma display apparatus includes a PDP 12, and a chassis base 16. The PDP 12 is mounted on one side surface of the chassis base 16, and a driving circuit 19 is affixed at the opposite side surface of the chassis base 16 to drive the PDP 12. The chassis base 16 and the PDP 12 are arranged substantially parallel to each other, and a heat transmission sheet (not shown) may be disposed between them to emit and diffuse heat generated from the PDP 12. A front cover (not shown) is placed external to the PDP 12, and a rear cover (not shown) is placed external to the chassis base 16. The front and the rear covers are combined with each other to construct a plasma display apparatus.

The PDP 12 has first and second substrates 121 and 123 facing each other while being sealed to each other, and a plasma discharge structure (not shown) disposed between the substrates. The plasma discharge structure is electrically connected to the driving circuit 19 mounted on the chassis base 16 to receive driving signals and voltages.

The first and second substrates 121 and 123 are roughly shaped as rectangular parallelepipeds having long sides 121*a* and 123*a* and short sides 121*b* and 123*b* while bearing a suitable thickness. The long side 121*a* of the first substrate 121 is larger than the long side 123*a* of the second substrate 123, and the short side 121*b* of the first substrate 121 is smaller than the short side 123*b* of the second substrate 123. Accordingly, in the case the two substrates 121 and 123 are aligned and sealed to each other, as shown in FIG. 2(*a*), the first substrate 121 has left and right protruded edge portions, and the second substrate 123 has upper and lower protruded edge portions.

The first and second substrates 121 and 123 have chamfered portions Ch1, Ch3, Ch4, and Ch6 processed along the edges of substrate surfaces directed toward the outside, that is facing away from each other. The surface of the first substrate 121 facing the second substrate 123 has a chamfered portion Ch5 processed along the edge of the short side 121*b* thereof, and the surface of the second substrate 123 facing the first substrate 121 has a chamfered portion Ch2 processed along the edge of the long side 123*a* thereof. In the drawing, the chamfered portions of the substrate edges proceeding symmetrical to each other are indicated by the same reference numeral.

The PDP 12 has cutting edges C1 and C2 along edges intersecting each other at the corner of the PDP 12, the edges being provided for each substrate surfaces facing each other. The cutting edge may be defined as a sharp edge which is not chamfered along the edge after being cut.

The long side 121*a* of the first substrate 121 has two longitudinal edges with different edge angles $\alpha$, and the short side 123*b* of the second substrate 123 has two longitudinal edges with different edge angles $\alpha$. As shown in FIG. 2(*b*), the edge angle $\alpha$ refers to the angle of the edge against the substrate surface adjacent thereto. The edge angle becomes an obtuse angle at the edge with the chamfered portion, and becomes roughly 90° at the edge with no chamfered portion.

As described above, the chamfered portions Ch1 to Ch6 formed at the edges of the respective substrates 121 and 123 are angled against the surfaces of the substrates 121 and 123 adjacent thereto by a predetermined degree, preferably at 30-45°, which is called the chamfered angle $\theta$. The chamfered angle $\theta$ is defined as an acute angle between the chamfered portion and the extended line of the substrate surface adjacent thereto.

Optionally, the chamfered portions Ch1 to Ch6 formed at the edges of the respective substrates 121 and 123 may be rounded with a predetermined curvature radius R, preferably of 0.9-1.5 mm.

In one embodiment, the chamfered portions Ch1 to Ch6 are formed by grinding the target edge with a grinder, or by firing it with a torch lamp.

The process of forming chamfered portions with a grinder will be now explained with reference to FIGS. 3 and 4.

Figure 3:
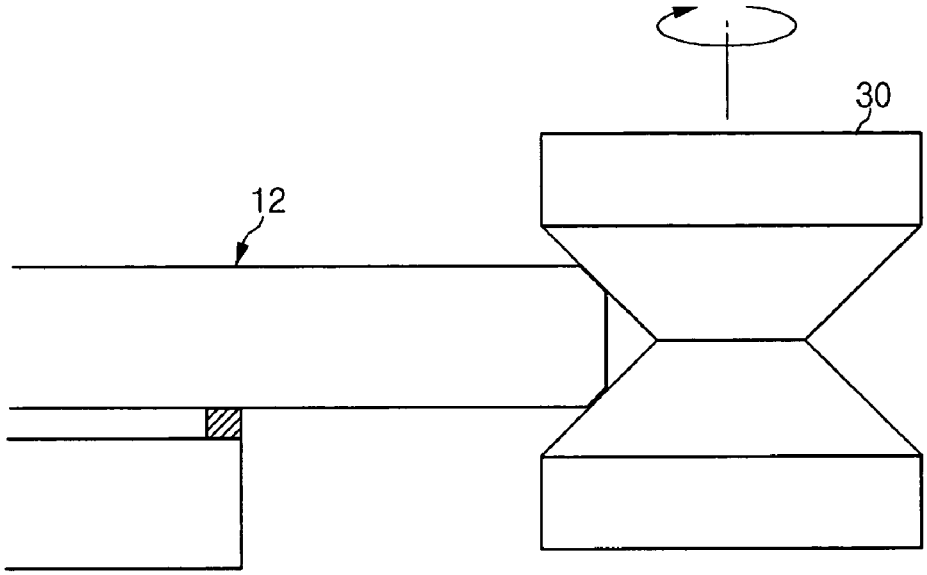
FIG. 3 schematically illustrates a process of chamfering protruding edges of a respective PDP substrates with a grinder.
Figure 4:
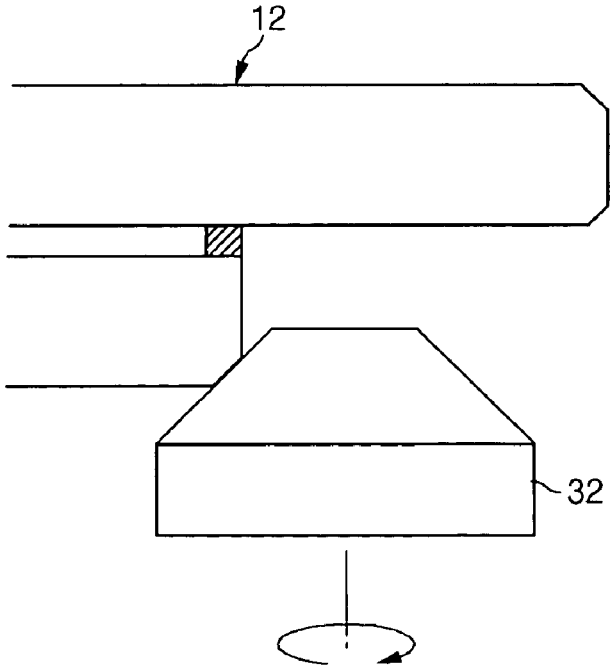
FIG. 4 schematically illustrates a process of chamfering only one side edge of the respective PDP substrates.

FIG. 3 schematically illustrates the process of chamfering the edges of protruding edge portion of the respective substrates with a grinder, and FIG. 4 schematically illustrates the process of chamfering only one edge of the respective substrates.

With the PDP delivered for the chamfering process, as shown in FIG. 2, the two substrates each with different-dimensioned long and short sides are sealed to each other. As shown in FIG. 3, a wasp-waisted grinder 30 is used to chamfer the edges of the protruding edge portion of the respective substrates. The chamfering angle of the respective chamfered portions can be controlled through varying the internal inclination angle of the grinder 30. With this chamfering process, the chamfered portions Ch1 and Ch2 are simultaneously formed, and the chamfered portions Ch4 and Ch5 are simultaneously formed.

The edge of the long side 121*a* of the first substrate 121 and the edge of the short side 123*b* of the second substrate 123 are chamfered with a grinder shown in FIG. 4, which is inclined in a predetermined direction. The chamfered angle of the respective chamfered portions can be controlled through varying the inclination angle of the grinder 32. In this way, the chamfered portions Ch3 and Ch6 are formed.

Figure 5:
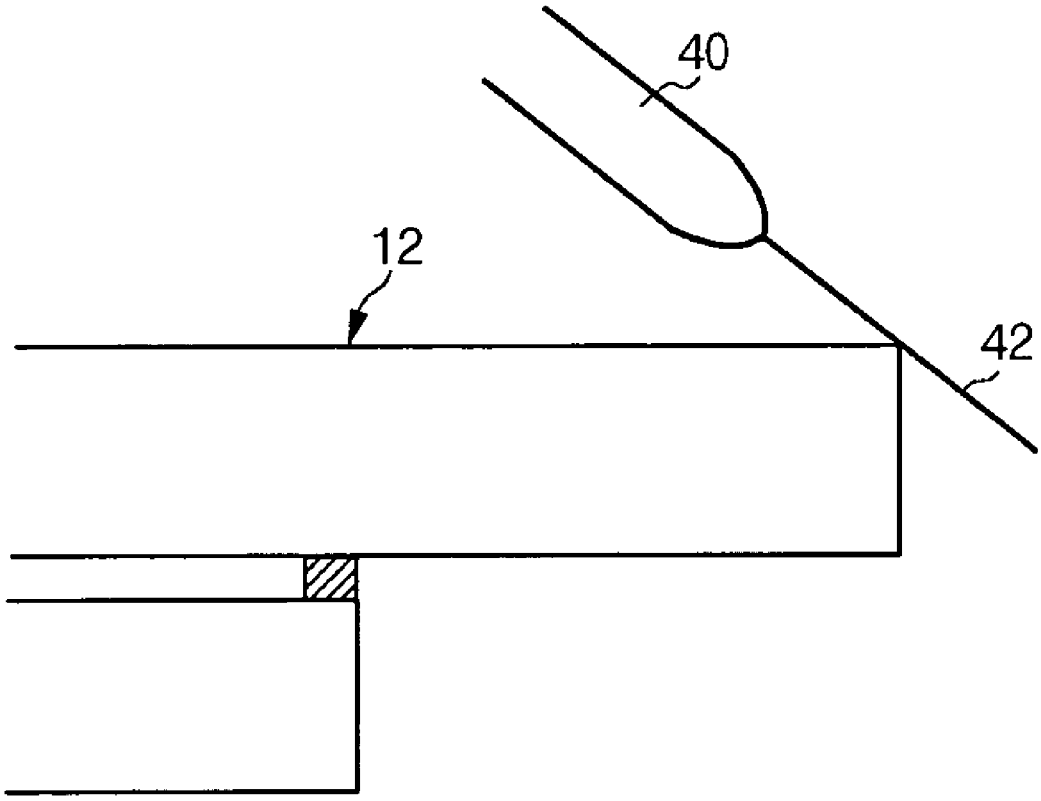
FIG. 5 schematically illustrates a process of chamfering edges of the respective PDP substrates with a torch lamp.

FIG. 5 schematically illustrates the process of chamfering the edges of the respective substrates with a torch lamp.

As shown in FIG. 5, the torch lamp 40 is placed with respect to the target substrate at a suitable inclination, and the needle-shaped flame 42 of the torch lamp 40 chamfers the edge of the substrate.

As described above, with the inventive plasma display apparatus, the substrate edges of the panels manufactured by the multiple panel formation process are processed through chamfering to prevent the respective substrates from being cracked during the subsequent processing or usage, thereby enhancing the reliability of the panels.

Although preferred embodiments of the present invention have been described in detail hereinabove, it should be clearly understood that many variations and/or modifications of the basic inventive concept herein taught which may appear to those skilled in the art will still fall within the spirit and scope of the present invention, as defined in the appended claims.

What is claimed is:

1. A plasma display apparatus comprising:

a plasma display apparatus comprising:

a plasma display panel having a first substrate, a second substrate facing the first substrate at one surface side and sealed thereto, and a plasma discharge structure disposed between the first and second substrates;

a chassis base positioned in close proximity to the plasma display panel at one surface side and in parallel with the plasma display panel; and a driving circuit mounted on the opposite surface side of the chassis base and electrically connected to the plasma display panel to drive the panel, wherein the first and second substrates of the plasma display panel have chamfered portions formed along the edges of the first and second substrate surfaces that face away from each other, wherein the first substrate and the second substrate are shaped as rectangular parallelepipeds each having long sides and short sides, the long sides of the first substrate being larger than the long sides of the second substrate, and the short sides of the first substrate being smaller than the short sides of the second substrate, wherein the first substrate and the second substrate are positioned such that the short sides of the first substrate extend in length beyond the short sides of the second substrate, and the long sides of the second substrate extend in length beyond the long sides of the first substrate, and wherein the surface of the first substrate facing the second substrate has a chamfered portion processed along the edge of the short sides thereof while the surface of the second substrate facing the first substrate has a chamfered portion processed along the edge of the long sides thereof.

2. The plasma display apparatus of claim 1, wherein the chamfered portions formed at the edges of the first and second substrates are angled by 30-45°, against the substrate surface adjacent thereto.

3. The plasma display apparatus of claim 1 wherein the chamfered portions formed at the edges of the first and second substrates are rounded with a curvature radius of 0.9-1.5 mm.

4. The plasma display apparatus of claim 1, wherein the chamfered portion is formed by grinding the respective edge with a grinder.

5. The plasma display apparatus of claim 1, wherein the chamfered portion is formed by firing the respective edge with a torch lamp.

6. A plasma display apparatus comprising:

a plasma display panel having a first substrate, a second substrate facing the first substrate at one surface side and sealed thereto, and a plasma discharge structure disposed between the first and second substrates;

a chassis base positioned near the plasma display panel at one surface side and in parallel with the plasma display panel; and a driving circuit mounted at the opposite surface side of the chassis base and electrically connected to the plasma display panel to drive the panel, wherein the first and second substrates of the plasma display panel are shaped as rectangular parallelepipeds each having long and short sides, wherein the long side of the first substrate is larger than the long side of the second substrate and the short side of the first substrate is smaller than the short side of the second substrate, wherein the first substrate and the second substrate are positioned such that the short sides of the first substrate extend in length beyond the short sides of the second substrate, and the long sides of the second substrate extend in length beyond the long sides of the first substrate, wherein the first substrate has chamfered portions along edges of the short sides thereof and the second substrate has chamfered portions along edges of the long sides thereof, and wherein longitudinal edges of the long side of the first substrate have different edge angles.

7. The plasma display apparatus of claim 6, wherein the longitudinal edges of the short side of the second substrate have different edge angles.

8. The plasma display apparatus of claim 6, wherein the edge angle of the longitudinal edge adjacent to the second substrate is smaller than the edge angle of the opposite side longitudinal edge.

9. The plasma display apparatus of claim 8, wherein the edge angle of the longitudinal edge adjacent to the second substrate is 90°, and the edge angle of the opposite side longitudinal edge is obtuse.

10. The plasma display apparatus of claim 7, wherein the edge angle of the longitudinal edge adjacent to the first substrate is smaller than the edge angle of the opposite side longitudinal edge.

11. The plasma display apparatus of claim 10, wherein the edge angle of the longitudinal edge adjacent to the first substrate is 90°, and the edge angle of the opposite side longitudinal edge is obtuse.

12. A plasma display apparatus comprising:

a plasma display panel having a first substrate, a second substrate facing the first substrate at one surface side and sealed thereto, and a plasma discharge structure disposed between the first and second substrates; and a driving circuit electrically connected to the plasma display panel to drive the panel, wherein the plasma display panel includes a plurality of cutting edges, all of the plurality of cutting edges formed to be non-collinear along edges intersecting each other at a corner of the plasma display panel and the edges are provided for the respective surfaces of the first and second substrates that face each other.

13. The plasma display apparatus of claim 12, wherein the first and second substrates have chamfered portions processed along the edges of substrate surfaces that face away from each other.

14. The plasma display apparatus of claim 13, wherein the first and second substrates are shaped as rectangular parallelepipeds each having long and short sides the long side of the first substrate being larger than the long side of the second substrate while the short side of side of the first substrate is smaller than the short side of the second substrate, and the surface of the first substrate facing the second substrate has a chamfered portion processed along the edge of the short side thereof while the surface of the second substrate facing the first substrate has a chamfered portion processed along the edge of the long side thereof.

* * * * *

UNITED STATES PATENT AND TRADEMARK OFFICE

CERTIFICATE OF CORRECTION

PATENT NO. : 7,368,871 B2
APPLICATION NO. : 11/000400
DATED : May 6, 2008
INVENTOR(S) : Jin-Sub Kim

It is certified that error appears in the above-identified patent and that said Letters Patent is hereby corrected as shown below:

| | |
|---|---|
| Column 4, line 57, Claim 1 | Delete "a plasma display apparatus comprising:" |
| Column 6, line 47, Claim 14 | After first occurrence of "side of", Delete "side of" |

Signed and Sealed this
Twentieth Day of September, 2011

David J. Kappos

David J. Kappos
*Director of the United States Patent and Trademark Office*